United States Patent [19]

Snyder et al.

[11] 4,318,489

[45] Mar. 9, 1982

[54] PLASTIC BOTTLE

[75] Inventors: John A. Snyder; Robert L. Wechsler, both of Bridgewater, N.J.

[73] Assignee: PepsiCo, Inc., Purchase, N.Y.

[21] Appl. No.: 174,242

[22] Filed: Jul. 31, 1980

[51] Int. Cl.[3] ..... B65D 23/00

[52] U.S. Cl. ..... 215/1 C; 220/70; 150/0.5

[58] Field of Search ..... 215/1 C, 1 P; 150/0.5; 220/69, 70

[56] References Cited

U.S. PATENT DOCUMENTS

| | | | |
|---|---|---|---|
| 3,511,401 | 5/1970 | Lachner | 215/1 C |
| 3,598,270 | 8/1971 | Adomaitis | 215/1 C |
| 3,638,826 | 2/1972 | Barker et al. | 220/69 |
| 3,643,829 | 2/1972 | Lachner | 215/1 C |
| 3,718,229 | 2/1973 | Wyeth | 215/1 C |
| 3,720,339 | 3/1973 | Khetani | 215/1 C |
| 3,722,725 | 3/1973 | Khetani et al. | 215/1 C |
| 3,722,726 | 3/1973 | Carmichael et al. | 215/1 C |
| 3,727,783 | 4/1973 | Carmichael | 215/1 C |
| 3,733,309 | 5/1973 | Wyeth et al. | 260/75 T |
| 3,759,410 | 9/1973 | Uhlig | 215/1 C |
| 3,811,588 | 5/1974 | Vermeerbergen et al. | 215/1 C |
| 3,820,181 | 3/1975 | Sincock | 215/1 C |
| 3,871,541 | 3/1975 | Adomaitis | 215/1 C |
| 3,881,621 | 5/1975 | Adomaitis | 215/1 C |
| 3,900,120 | 8/1975 | Sincock | 215/1 C |
| 3,934,743 | 1/1976 | McChesney | 215/1 C |
| 3,935,955 | 2/1976 | Das | 215/1 C |
| 3,948,404 | 4/1976 | Collins et al. | 215/1 C |
| 4,108,324 | 8/1978 | Krishmakumar et al. | 215/1 C |
| 4,134,510 | 1/1979 | Chang | 215/1 C |
| 4,174,782 | 11/1979 | Obsomer | 215/1 C |

*Primary Examiner*—George T. Hall

*Attorney, Agent, or Firm*—Bernard, Rothwell & Brown

[57] ABSTRACT

A plastic bottle for holding liquids such as carbonated beverages under pressure. The bottle, a one-piece, self-standing biaxially-oriented plastic container, is generally cylindrical in body configuration with a spherical bottom from which several lobes or feet extend for supporting the bottle upright on a surface. The feet are also spherical in configuration and extend downwardly from the container bottom adjacent to the sidewall of the cylindrical body to support the bottle in a more stable upright position. The center of the bottom of the bottle may be depressed inwardly into the bottle to increase the clearance between the bottom and a surface on which the bottle stands. The configuration of the bottle serves to impart adequate strength and good resistance to eversion. The bottle can be made with a minimal amount of plastic for given performance characteristics, and at speeds that are economical, even for relatively small bottles.

15 Claims, 4 Drawing Figures

PLASTIC BOTTLE

BACKGROUND AND DISCUSSION OF THE INVENTION

This invention pertains to bottles for holding liquids, and in particular the invention concerns one piece, self-standing, plastic bottles suitable for containing carbonated beverages or other liquids under pressure.

Until more recent years liquids have been stored primarily in various containers made of metal, ceramics and glass. Many liquids sold to consumers have been contained in transparent bottles and this is particularly true with respect to liquid products that are destined for human consumption. Glass bottles have been used in great abundance for many years as containers for such liquids, but these vessels have a number of unattractive properties. For example, glass bottles are fragile which may lead to container breakage resulting in product and container loss, and even bodily injury. The bottles are heavy and cause substantial expenditures in energy during manufacture and transportation.

These and other considerations have caused many products to be stored in plastic containers which may be transparent, translucent or opaque. The type of plastic used in making these containers is chosen according to the properties needed to hold liquids of given types. For liquids under essentially atmospheric pressure, the shape of the container and its manufacturing procedure may vary considerably. Also, a number of plastics meet the physical and chemical requirements under these circumstances, and the use of the least expensive plastic becomes a primary consideration in selecting the type of plastic used. The shape of the bottle may be varied widely depending on factors such as liquid capacity, cross-sectional area of the container and attractiveness to the consumer. However, in the case of liquids held under elevated pressure, the choices in various respects can be materially lessened. Thus, the shape of the container or bottle is generally the strongest cylinder, i.e. an essentially circular cylinder, and the plastic bottle is formed by biaxial orientation which develops the strongest side walls which, due to economic considerations, are generally quite thin. In order that the bottle will retain its shape when stored with its liquid contents under pressure, the composition of the plastic is chosen to have sufficient creep resistance, and may be, e.g., polyethylene terephthalate (PET), styrene-acrylonitrile copolymers, polycarbonates, polysulfones, polyvinyl chloride and the like.

In order that the plastic bottle be the most convenient to manufacture and of lower cost, it is desired to obtain a one piece, self-standing bottle. The nature of the bottom of the bottle is very important, not only because it is most desirable that the bottle stand upright on a generally flat surface, but also because the bottom is subjected to bending moments which tend to distort the shape of the bottom and make the bottle unstable in standing upright. The bottom must, therefore, adequately resist the bending forces in order to remain standing. A cylindrical bottle having the greatest volume with the use of the least amount of plastic material would have a hemispherical bottom, but, of course, such a bottle will not free-stand in the upright position. Although the bottom of the bottle may have somewhat greater thickness than the sidewall of the body of the bottle and thereby have greater strength and resistance to gas permeation, the shape of the bottom may distort under the stress of the liquid and gas pressure in the bottle. If the bottle originally has a flat-bottom that becomes distorted when stored with its liquid contents under elevated pressure, the bottle, if it does not fracture, will become unsteady and may topple. Such bottles are commonly referred to as "rockers". Plastic bottle bottoms of other shapes may also distort and become rockers under various conditions of storage and use.

Although there have been quite a number of prior proposals regarding the configuration of the bottoms of one-piece, self-standing, plastic bottles for containing pressurized liquids, relatively few have appeared on the market. Some of these were not particularly stable and had liquid capacities of at least about one liter, say up to about 2 liters or so.

In the past the design of one-piece plastic bottles suitable for elevated pressure use has led to relatively high manufacturing costs due, for example, to the use of a relatively large amount of plastic for a given volume of bottle and, quite importantly, to slow manufacturing procedures. Major attention has been given to obtaining improvements in the stability, or non-everting, properties of the bottom of the single piece, free-standing bottles. Designs such as those described in U.S. Pat. Nos. 3,598,270; 3,727,783; 3,871,541; 3,935,955; 4,108,324; 3,718,229; 3,722,726; 3,881,621 and 4,134,510 are relatively complicated with, for example, reinforcing ribs and reverse directing arcs. In general, these designs require high forming pressures and longer equipment cycle times. Further, the more complicated designs inhibit uniform biaxial orientation during bottle forming and reduce the material efficiency usage, i.e. it requires more material to produce a bottle bottom that does not evert at the higher range of use temperatures and pressures.

Other simpler bottle designs such as those shown in U.S. Pat. Nos. 3,759,410; 3,511,401; 3,643,829; 3,811,588; 3,870,181 and 3,934,743 employ plastic materials, e.g. acrylonitriles, acrylates or polyvinylchlorides. Generally, these designs require heavier walls to retain their shape at the higher use stress and temperature levels. Further, the costs of the materials are relatively high.

In summary, the simpler, non-everting, carbonated beverage bottle designs of the prior art generally apply to more expensive plastics while more complicated, less material efficient and more difficult to form designs have been proposed for producing non-everting, free-standing carbonated beverage bottles from materials such as polyethylene terephthalate.

The one-piece bottles have been made by blow molding techniques employing a preformed parison, and the speed of this operation is controlled by heating and cooling rates and other factors such as the ease of forming the shape needed and the facility with which the bottle can be removed from the forming mold. In the case of relatively large bottles of say 2 liter-capacity, the overall cost of making one-piece bottles may be greater than for two-piece bottles, even though the latter require additional manufacturing steps and a greater number of bottle parts. Therefore, the challenge of economically making one-piece, plastic bottles has remained, and is particularly acute in the area of bottles of about one liter in capacity. In the latter case, the manufacturing cost is even more important since the volume of liquid contents sold per unit container is reduced while the amount of plastic material utilized per unit of liquid content is increased.

As bottle size decreases its surface to volume ratio increases. This relationship dictates heavier average walls for the bottle to retain a specified percentage of original gas content. In addition, as bottle size decreases, the degree of biorientation in the bottle wall becomes more difficult to achieve since there are shorter available distances for material stretching while forming the bottle from the parison, and since the heavier walls required to retain the gas content dictate less draw-down from the parison dimensions. Thus, in smaller bottles there tends to be less orientation and thus less resistance to creep than in larger bottles of similar wall thickness. The efficiency of material usage in smaller bottles is, thus, significantly less than in larger bottles.

These difficulties have led to greater use of the two-piece, larger plastic bottles for holding liquids under pressure, e.g. carbonated beverages, particularly soft drinks. The main portion of the upper piece of the bottle is a biaxially oriented, synthetic resin or plastic structure having an essentially circular cross-section and a spherical bottom, see U.S. Pat. Nos. 3,722,725 and 3,948,404. In order to make the bottle stand upright on its lower end opposite the cap, the spherical bottom of the bottle is held in a round cup having a generally flat bottom. Such cups involve additional expense and manufacturing procedures, and the cups are subject to breakage or loss from the bottle.

The present invention is directed to one-piece, self-standing, biaxially-oriented, plastic bottles suitable for holding liquids under pressure, for example, carbonated beverages, over a shelf-life satisfying commercial standards of performance and cost. The bottles have an integrally-formed bottom that is constructed in a manner maximizing the strength, toughness, uniformity of orientation, and standing stability of the bottle on its lower end. Any creep of the bottle during storage usually is insufficient to cause the bottle to evert or fall on its side or even to become a rocker. Moreover, the shape of the bottle minimizes the amount of plastic material that need be employed in forming a bottle of given capacity and strength, i.e. there is good material efficiency. In making the bottle the speed of manufacture is markedly improved, e.g. the molding cycle is shorter, compared with many prior one-piece plastic bottles destined for such use. In now appears quite feasible to manufacture the bottles of the invention economically, even bottles that do not exceed about 1 liter in liquid capacity.

The bottles of the present invention are characterized by several features including a bottom having surface portions that are approximately spherical. The bottom of the bottle is spherical and contains a plurality of lobes or feet extending downwardly on the outside surface and around the periphery of the bottom. The feet have a substantially spherical lower portion and the horizontal diameter of the feet has its outer end substantially in line with the vertical sidewall of the main body of the bottle, and as a result the bottle has good standing stability. Thus, the outer sidewall of the upper part of the feet above the lower, spherical portion of the feet is in essence a vertical extension of the sidewall of the body of the bottle.

The feet are formed from, and are therefore extensions of, the relatively thicker spherical bottom. The feet have relatively thin walls compared with those of many prior bottles, and the stretching of the plastic in forming the feet results in good biaxial orientation. The outer periphery of the spherical feet, or a vertical extention of the outer periphery, intersects the spherical surface of the bottom of the bottle. Thus the tops of the feet do not flare outwardly from the maximum diameter of their spherical bottom, except, if desired, in the vicinity of the intersection with the bottom of the bottle. As a result, the vertical extensions of the feet are narrower at their tops than along their sides when viewed from the outer sides and from this standpoint the feet may be considered to be generally similar in shape to a teardrop. An advantage in this structure is that the bottom of the bottle does not undergo the extent of stretching that would be required if the tops of the feet flared outwardly, and, as a result, for a given bottom thickness the feet formed from the bottom are stronger and more uniform in thickness and orientation. The feet are, thus, formed with good material efficiency and exhibit high impact strength. The number of such feet on the bottom of the bottle is at least 3 or 4, preferably at least 5, say up to about 9, especially 5 to 7. A greater number of such feet does not seem particularly advantageous, and the expense of a more complicated mold needed to form the bottle has not been found to be justified.

The dimensional and structural relationships stated herein can be taken as referring to the mold in which the bottle is shaped as well as the actual bottle. The shape of the bottle may vary somewhat due, for example, to minor inconsistencies or variations in the molding process and to shrinkage of the bottle during cooling. The mold may be shaped to allow for such shrinkage.

The simplicity of the design of the bottle of the invention employing a spherically-shaped bottom with spherical extensions to provide standing stability permits the fullest application of the surface-to-volume ratio efficiency of spheres. This configuration provides maximum toughness, minimum permeability and minimum creep to be achieved with the least amount of plastic utilization. In addition, the shape of the bottom facilitates uniform biorientation and formability, since material movement in the bottom emanates essentially unobstructedly from a single center, i.e., that of the principal base sphere.

The feet of the bottle of the invention are of substantially circular cross-section and are spaced-apart from one another around the periphery of the bottom of the bottle in a manner that provides a surface between adjacent feet having a shape approximating the principal spherical surface of the bottom. The feet thus have relatively small diameters. It is preferred that the upper sidewall of the feet merge as a radius into the principal surface of the spherical bottom, except for the outermost portion of the upper sidewall of the feet which is more or less directly below the wall of the body of the bottle. Thus, the outermost wall portion of the feet is in essence a vertical, extension of the sidewall of the body of the bottle as noted above. A portion of the principal spherical surface of the bottom of the bottle is positioned interiorly of the feet.

Although the principal spherical surface of the bottom of the bottle of the invention may extend more or less throughout the central area interiorally of the feet, from the aesthetic and standing-stability standpoints this may be unattractive. Accordingly, the center portion of the bottom of the bottle may be depressed inwardly relative to the principal spherical surface of the bottom and this will provide greater clearance from a surface on which the bottle stands to insure that some growth or creep of the bottle will not extend the center portion of the bottom to below the lowermost portions of the feet to upset the bottle or produce a rocker upon storage with pressurized liquid therein.

The configuration of the one-piece bottle of the invention provides a bottom with satisfactory strength and the bottle is resistent to undue deformation that could otherwise cause the bottle to become a rocker and even topple when standing on the feet. The portions of the feet in contact with a generally flat or somewhat inclined surface on which the bottle stands are positioned relatively close to the outer periphery of the bottle due to the relatively small diameter of the feet. This configuration increases the standing stability of the bottle. Yet the bottle can be made by blow molding at relatively fast rates using a mold of simple configuration compared to some structures that have theretofore been proposed. The shape of the bottom of the bottle permits the use of a minimum amount of plastic in forming the bottle. These and other advantages of the bottle of the invention as stated above become apparent from the following detailed description of the bottle and the drawings.

DESCRIPTION OF THE PREFERRED EMBODIMENT

Figure 1:
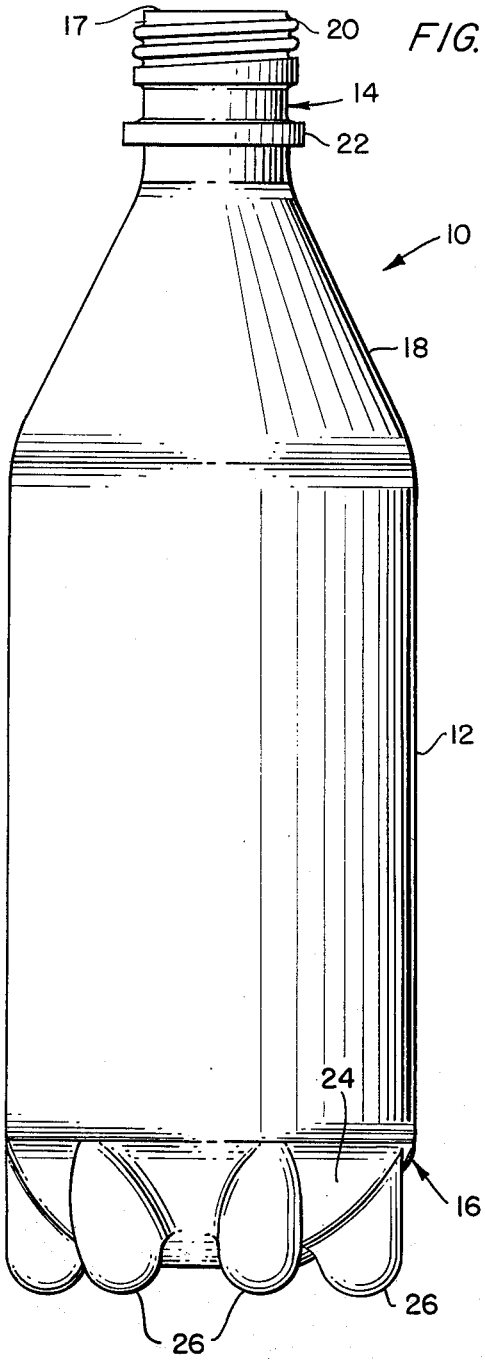
FIG. 1 is an elevation of the bottle of the invention.

Referring to FIG. 1, there is shown an elevation of a bottle of the preferred embodiment of the invention that is suitable for holding a carbonated soft drink, for example a bottle of approximately 0.5 liter capacity. The bottle 10 is a hollow container and includes a circular, cylindrical main body portion 12 which constitutes the largest portion of the bottle. At the top of body 12 there is an upper conical portion 18 inclined inwardly and upwardly to neck 14 extending from the upper end portion 18. The bottom 16 at the lower end of the bottle 10 is integrally formed on body 12 by blow molding a closed end, smaller parison. The blow molding extends the length and diameter of the parison to provide the biaxially-oriented bottle. The bottom has seven feet or lobes 26 on which the bottle rests in vertical position when placed on a horizontal support. Neck 14 has an upper opening 17 therethrough to provide access for filling and pouring liquid from the bottle. Neck 14 can be a standard threaded exterior surface 20 for receiving a closure to seal opening 17 to contain the liquid and carbon dioxide gas within the bottle once it has been filled with liquid and pressurized with the gas. Flange 22 extends from beneath the threaded portion and may be used in the capping or bottling process or as an assist in pouring liquid from the bottle. Typically, the pressure in such bottles may range from about 25 to 125 psig. As examples, at 35° F. the pressure may be about 35 psig while at 95° F. the pressure may be about 110 psig or so. Various normally solid, thermoplastic plastic or resinous materials can be employed as the material of construction of the bottle of the invention as noted above. A preferred material is polyethylene terephthalate (PET).

Polyethylene terephthalate provides a combination of properties suitable for packaging economically carbonated beverages gasified to the U.S. commercial standards, typically about 1.5 to 5 volumes of $CO_2$ per volume of beverage. The U.S. FDA has accepted the use of PET for containing carbonated beverages for human consumption. PET resins of the preferred molecular weight for beverage bottles, typically about 0.6 to 1 intrinsic viscosity, have provided commercial performance in the one and two liter bottle sizes and at costs competitive overall to those of similar-size glass bottles. The degree of biaxial orientation, in the major cylinder walls and bases of these bottles is sufficient to provide adequate yield strength and, thus, bottle stability. Further, the degree of biaxial orientation in the bottle walls plus its thickness provide adequate gas retention or barrier properties to maintain a sufficiently long product shelf life. As noted, the creep resistance or dimensional stability of these bottles is satisfactory as evidence of their retention of dimensions when exposed to use temperatures up to 95°–100° F. and the resulting internal pressures of the order of 100 psig.

An important feature of the invention concerns the manner in which the bottom portion 16 of the bottle is constructed to provide the ability to support bottle 10 in a stable manner when placed on a flat or relatively flat surface, and under the elevated pressure in the bottle exerted by the gas and the liquid contained therein, as well as provide the other characteristics discussed above. In the manufacture of the bottle, it is desirable when forming the bottom 16 to provide spherical surfaces as these are the most efficient in terms of containing the pressure developed within the bottle with the smallest wall thickness practical. This results at least in part from the uniform high degree of biorientation in the spherical form as well as the strength of round and spherical structures. Thus the bottom portion 16 of the bottle should be a melding of surfaces and elements to maintain or approximate spherical configurations, while simultaneously providing stability when the bottle is placed on the feet of bottom portion 16 and filled with the liquid and gas.

The bottles of the invention are of essentially circular cross-section and can have relatively thin body sidewalls having, for example, thicknesses that may range from about 10 or 12 to 30 or 35 mils, preferably about 12 to 25 mils. The feet may have thicknesses in the ranges noted for the sidewall of the body of the bottle, and since the feet are formed from the smaller surface portion of the bottom of the bottle the thickness of the feet will generally be less than that of the principal spherical surface of the bottom. The center of the bottom may have a thickness of, say, about 30 to 100 mils, preferably about 40 to 65 mils. The bottles are particularly advantageous in that they can be made in relative small sizes of up to about 1 or 1.5 liters in capacity, especially about 0.25 to 1 liter. The capacity of the bottles may be up to about 2, 3, 5 or more liters. The height to diameter ratio of the bottles may generally be at least about 1.5:1 and may be up to about 5:1 or so, preferably being about 2 to 3:1. The diameter of body 12 may be, for example, about 2 or 2.5 to 7 inches, preferably about 2.5 to 5 inches, or about 2.5 to 3.5 for approximately half-liter bottles.

Figure 3:
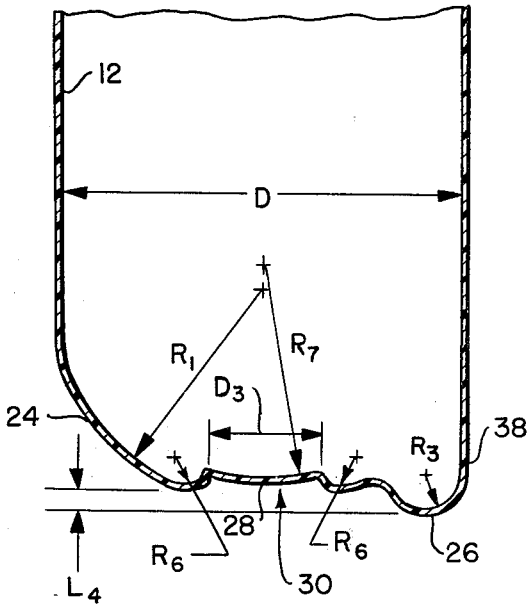
FIG. 3 is a cross-sectional view of the bottle in FIG. 2 taken along lines 3—3 with an upper portion of the bottle removed.

In FIG. 3, a number of radii are shown to designate various curves in bottom portion 16. These radii are chosen as a matter of definition for the planar section shown in the figure; however, it should be understood that these curves, unless otherwise specified, are surfaces of revolution where a given radius is substantially constant with respect to the center line of bottle 10. The major deviation in this respect is the dimension of the feet or lobes 26 which are not surfaces of revolution about the center line of bottle 10, but rather each foot or lobe 26 is a spherical portion taken about its own axis.

Bottom 16 has a basic principal spherical surface 24 with the lobe or satellite feet 26 extending downwardly therefrom. The spherical surface 24 extends along radius $R_1$ which may be continuous across the bottom 16 or be interrupted by depression 30 as shown in FIG. 3. In the latter case portions of the $R_1$ radius will be on more or less opposite sides of the bottom between adjacent feet. Radius $R_1$ on a given side of the bottom, that is, from the sidewall to the center of the bottom will generally swing through an arc of at least about 30° or 35°, up to 90° in the case of a hemispherical bottom. Preferably, this arc is in the range of about 40° to 70°. For a number of bottles the length of radius $R_1$ is about 1 or 1.2 or 5 inches, preferably about 1.5 to 3 inches. The bottom portion of the principal surface 24 inwardly of the feet, if not along radius $R_1$, may be a bottom center portion 28 that can be formed primarily by an arcuate portion radius $R_7$ whose center lies on the center line of bottle 10 spaced above the center of spherical surface 24 by a distance essentially equal to the distance that the surface formed as $R_7$ is spaced away from a projection of $R_1$ to the center of the bottle. These radii, $R_1$ and $R_7$, can be substantially equal. Radius 7 may extend through an arc of about 10° to 90°. In the embodiment of FIG. 3 the surfaces formed by radii $R_1$ and $R_7$ are connected by a smaller radius portion $R_6$ which in the size bottles indicated may be a radius of about 0.1 to 1 inch, often about 0.3 to 0.7 inch. In this manner a concentric depression can be formed in the bottom portion 16 of bottle 10 which depression may have a diameter D3 of about 0.5 to 3 inches and circumscribes the center line of the bottle. This dimension may preferably be about 0.7 to 2 inches.

With regard to the dimensions of the bottle of the invention, the absolute values noted may vary with the size of the bottle. Consequently, it seems appropriate to express these dimensions in terms of ratios. Thus, the ratio of radius $R_1$, or $R_7$, to D may be in the range of about 0.45 to 0.8:1, and preferably about 0.5 to 0.8:1. The ratio of $R_6$ to $R_1$ may be about 0.05 to 0.6:1, often about 0.1 to 0.3:1. The ratio of the diameter of the bottle body 12(D) to D3 may be typically be about 2 to 7:1, often about 3:1.

Figure 2:
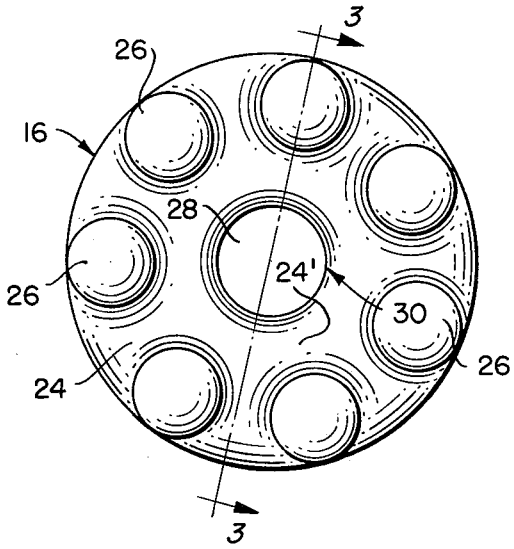
FIG. 2 is a bottom view of the bottle shown in FIG. 1.

The principal spherical surface 24 which serves as a base from which feet 26 extend, provides an efficient pressure-containing surface for areas of the bottom 16 and a smooth transition to depression 30. As can be seen from FIG. 2, depression 30 is circular, concentric with and spaced from side walls of cylindrical portion 12. The lowermost portion of depression 30 is spaced further upwards from the bottom surface of feet 26 than would be a continuation of surface 24 to the center of the bottle. With this configuration the non-everting feature of the bottle is improved, since greater creep of the bottom can occur without touching a surface on which the bottle stands.

It can be seen in this configuration that the lobes extend downwardly adjacent the periphery of the outer cylinder and beyond the lowermost position of the bottom center portion 28 of bottle 12 which may be depression 30 or even surface 24 if the depression is not present. In this manner, stability is achieved in supporting the bottle by the feet being located adjacent to the periphery of the bottle and extending a distance beyond the bottom 28 of the bottle. Bottom center portion 28 of the bottle 12 in its unfilled state may typically be at least about 0.05 inch and may be up to about 0.3 inch or so in distance or height above the lowermost portion of lobes 26, and preferably the distance may be about 0.07 to 0.15 inch. This dimension can change depending upon the size of the container and lobes. For example, a container having a body 12 of a larger dimension D may be greater in this dimension, while a smaller diameter D bottle may have lesser height dimension between the lowermost portion of lobes 26 and bottom center portion 28. If the dimension between the lowermost portion of lobes 26 and the lowermost portion of the bottom is L4, the ratio of D to L4 may be in the range of about 15 to 50:1, and preferably is about 25 to 40:1.

Lobes 26 have a spherical bottom configuration and a location which places their outermost peripheral surfaces substantially in vertical alignment with the wall of body 12 to provide the stable support features of the invention. The feet are preferably spaced symmetrically around the bottom of the bottle. Also the feet in a given bottle are preferably substantially identical, although there may be slight variances in this respect. In some embodiments lobes 26, have a radius $R_3$ of about 0.2 to 1.3 inch, and preferably about 0.4 to 0.8 inch. The ratio of D to $R_3$ may be, for example, about 4 or 4.5 to 18:1, often about 5 to 10:1. $R_3$ can be swung through an arc of about 90° C. to 240°, preferably about 120° to 180°. Connecting the feet 26 to the cylinder wall is a vertical transitional surface 38 extending downwardly from spherial surface 24 to the outer periphery of a given foot 26. The outer extremity of surface 38 is essentially in vertical alignment with cylinder wall 12. The downward length of surface 38 becomes shorter as it extends towards the inner side of a given foot and the length depends on the distance feet 26 extend downward from surface 24, as does the extent to which surface 38 is formed around the periphery of the upper base of the spherical bottom portion of a given foot 26.

It is preferred that the portion of feet 26 or surface 38 which intersects surface 24 do so as a radius turning outwardly from the feet to blend into surface 24 in a smooth transitional manner. This transitional surface is, however, not so great that surface 24 is completely destroyed between adjacent feet. Thus the amount of surface 24 remaining between adjacent feet may be at least about 0.05 inch, preferably at least about 0.08 or 0.1 inch, measured as an arc from the center of the bottle at the location of minimum spacing between the feet.

In the bottle of the invention the surface 38 intersects base 24, and surface 38 continues downward from base 24 to meet the outer periphery of the spherical feet 26. Surface 38 generally extends around at least a major portion of the periphery of the feet. It can be seen from FIG. 1 that the vertical surface 38 does not flare outwardly to any significant extent, if at all, from the periphery of the bottom spherical portion of feet 26. As a result the top part of surface 38 has considerable smaller horizontal peripheral dimensions than the lower portion of this surface. Surface 38 may approximate a point at its upper end, and when viewed from the outer side the spherical portion of feet 26 and surface 38 appear to be more or less in the shape of a teardrop. This constructions permits the formation from a bottom 24 of given thickness, of feet of greater thickness, strength and orientation than would be the case if surface 38 flared outwardly as it extends upwardly towards bottom 24.

The connection of the vertical surface 38 to the spherical surface 24 may be a gradual blend approximating a radius. By eliminating any sharp change in direction from the base spherical surface to the feet in this way, the shape of the feet viewed upwardly from the outside of the bottom may appear similar to that of a droplet of liquid deposited on a surface. In a preferred embodiment there are 7 lobes or feet equally-spaced about the bottom portion 16 with the centers for $R_3$ of each lobe lying in essentially the same plane. By using an odd number, no two lobes are diametrically opposed to one another. This removes the opportunity for a standing container to pivot about any two points on opposed feet; by having as many as seven (7) feet there are a number of supports to prevent or impair bottle 10 from being toppled. Also, as the radius of the feet become smaller the standing bottle is supported further from its center and, thereby, becomes more stable. However, as few as three and as great as nine or more feet may be employed.

Figure 4:
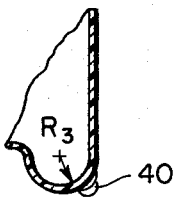
FIG. 4 is a partial view of a cross-section of a bottle showing another embodiment of the feet of the bottle.

Furthermore, additional smaller lobes 40 can be added to the feet lobes as shown in FIG. 4. These smaller lobes 40 extend outwardly from lobes 26 between the lower portion of lobes 26 and the outermost portion of lobes 26 adjacent the sidewall of cylinder portion 12. These smaller lobes 40 are located to provide a support surface approximately equal to or even beyond the periphery of cylinder portion 12, to further enhance bottle stability.

As previously noted, the strength and non-everting characteristics of the bottle of the invention may be enhanced by there being at least a portion of spherical surface 24 positioned inwardly of feet 26 or any transitional surface between the feet and surface 24. This surface designated as 24' in FIG. 2 may be at least about 0.05 inch, preferably at least about 0.08 or 0.1 inch as measured along surface 24 taken on a line from the center of a given foot to the center of the bottle.

Since at least for the most part the dimensions and ratios stated above are expressed in ranges as they may be applicable to bottles of various sizes, for example, for bottles of approximately 0.5 to 2 liters capacity, it seems desirable to also define typical dimensions as they may be applied to bottles of approximately 0.5 liter capacity and to bottles of approximately 2 liters capacity. These are presently popular bottle sizes. These dimensions and ratios are stated as approximations in Table I.

TABLE I

| | Half-Liter Bottles | | 2-Liter Bottles | |
|---|---|---|---|---|
| Dimensions/Ratios | General | Preferred | General | Preferred |
| Height, H, inches | 6–12 | 7–8 | 10–14 | 12 |
| Diameter, D, inches | 2.5–3.5 | 2.7–3 | 3.5–6.5 | 4–5 |
| Ratio, H/D | 1.7–4.8:1 | 2.2–2.8:1 | 1.5–4:1 | 2.5–3:1 |
| D3, inches | 0.5–1.3 | 0.8–1 | 1–3 | 1.2–2 |
| D/D3 | 2–7:1 | 2.5–4:1 | 2–7:1 | 2–4:1 |
| $R_3$, inches | 0.25–0.75 | 0.35–0.5 | 0.35 –1.25 | 0.5–1 |
| $D/R_3$ | 4–14:1 | 5–8:1 | 5–18:1 | 5–8:1 |
| $R_1$, inches | 1.2–2.5 | 1.5–2 | 1.5–5 | 2–3 |
| $R_1/D$ | 0.45–0.8 | 0.5–0.7 | 0.45–0.8 | 0.6–0.8 |
| Wall Thickness, mils | | | | |
| Cylinder Wall | 10–30 | 15–25 | 10–25 | 14–20 |
| Center of Base | 30–85 | 40–50 | 40–100 | 50–60 |
| Foot at maximum | | | | |

TABLE I-continued

| | Half-Liter Bottles | | 2-Liter Bottles | |
|---|---|---|---|---|
| Dimensions/Ratios | General | Preferred | General | Preferred |
| diameter | 10–25 | 12–20 | 10–35 | 12–20 |
| L4 | 0.05–0.2 | 0.075–0.15 | 0.07–0.25 | 0.1–0.15 |
| D/L4 | 15–50:1 | 25–30:1 | 20–50:1 | 30–40:1 |
| $R_6$ | 0.12–0.5 | 0.3–0.4 | 0.12–1 | 0.3–0.7 |
| $R_6/R_1$ | 0.05–0.4:1 | 0.15–0.25:1 | 0.02–0.6:1 | 0.15–0.25:1 |

As explained above, the base of the bottle usually expands somewhat when pressured as do virtually all thin-walled, plastic bottles. However, in contrast to other designs found in the prior art (especially those that rest on individual feet as distinguished from a circular support ring) the expansion of the base of the bottle of the invention produces major forces which are tensile forces acting outwardly in the base walls in all directions and in the spherical feet, as well as in the base spherical bottom. This may result in slight extension of the feet to provide an enlarged support or standing base diameter and thus a more stable bottle.

The bottle of the invention also has advantages which render the bottle more amenable to the molding process. In forming the bottle a preform or parison can be expanded in all directions to the smooth, basic spherical surface across the bottom of the mold base. The spherial extensions or feet 26 emanating further from the smooth contour 24 permit continued uniform biorientation to be developed in the feet to form relatively thin, tough, creep-resistant supports for the bottle. The thin-walled feet exhibit a faster cooling rate which decreases the cycle time needed to form the bottle compared with many prior designs. Furthermore, the high, uniform biorientation in the spherical feet provides them with a higher degree of toughness and creep resistance, than is otherwise predictable from their thickness. The feet and, therefore, the bottle of the invention provide good material efficiency which enhances the economic attractiveness of the invention.

The foregoing has included a detailed discussion of preferred embodiments of the invention, and is not necessarily intended to limit its scope.

It is claimed:

1. A self-standing, biaxially-oriented, plastic bottle having a body with a generally vertical wall of substantially circular cross-section, said bottle having a bottom depending from said wall, said bottom being formed integrally with said body and having a principal spherical surface, said bottom having at least three depending feet positioned around the periphery of said bottom on which feet the bottle stands vertically on a horizontal surface, the lower portion of said feet being of substantially spherical configuration, said feet having a wall portion above said spherical portion with the outer periphery of said wall portion taken from the center of the bottle being in substantial vertical alignment with the wall of said body, said principal spherical surface of said bottom extending between adjacent said feet and inwardly of said feet toward the center of said bottle.

2. A bottle of claim 1 in which the center portion of the lower end of said bottom is positioned inwardly of a continuation of said principal surface of the bottom if projected to the center of said bottle.

3. A bottle of claim 1 or 2 in which the number of said feet is 5 to 7.

4. The bottle of claim 1 or 2 in which the periphery of said feet merge into said principal spherical surface as a radius.

5. A bottle of claim 4 in which the number of said feet is 5 to 7.

6. The bottle of claim 1 or 2 in which the ratio of the diameter of said body to the radius of said feet is about 4 to 18:1.

7. The bottle of claim 1 or 2 in which the plastic is polyethylene terephthalate.

8. The bottle of claim 7 in which the ratio of the diameter of said body to the radius of said feet is about 4 to 18:1.

9. The bottle of claim 8 in which the liquid capacity of the bottle is about 0.25 to 1 liter.

10. A self-standing, biaxially-oriented, thermoplastic bottle having a vertical body of substantially circular cross-section, said body having a wall with a radius of about 2.5 to 5 inches, the wall of said body having a thickness of about 12 to 25 mils, a bottom of said bottle depending from said wall and formed integrally therewith, said bottom having a principal spherical surface, the ratio of the radius of said spherical surface to the diameter of said body being about 0.5 to 0.8, 5 to 7 feet depending from and positioned around the periphery of said bottom by which said bottle can stand in vertical position on a flat surface, said feet having a lower portion of substantially spherical configuration and having a wall portion above said spherical portion with the outer periphery of said wall portion taken from the center of the bottle extending in substantial vertical alignment with the wall of said body, said principal spherical surface of said bottom extending between adjacent feet and inwardly of said feet toward the center of said bottle, the diameter of said body having a ratio to the radius of said feet of about 5 to 10:1, and the periphery of said feet merging into said principal spherical surface as a radius.

11. A bottle of claim 10 in which the center portion of the lower end of said bottom is positioned inwardly of a continuation of said principal surface of the bottom if projected to the center of said bottle.

12. The bottle of claim 11 in which said thermoplastic is polyethylene terephthalate.

13. The bottle of claim 10, 11 or 12 in which the number of feet is 7.

14. The bottle of claim 10, 11 or 12 in which the liquid capacity of the bottle is about 0.25 to 1 liter.

15. The bottle of claim 14 in which the number of feet is 7.

* * * * *